US005980993A

United States Patent [19]

Mauer et al.

[11] Patent Number: 5,980,993

[45] Date of Patent: Nov. 9, 1999

[54] METHOD FOR APPLYING A COLOR-PLUS-CLEAR COMPOSITE COATING TO A SUBSTRATE

[75] Inventors: George W. Mauer, Brunswick Hills, Ohio; Donaldson J. Emch, Brighton, Mich.; Roxalana L. Martin, Pittsburgh; Edward R. Coleridge, Lower Burrell, both of Pa.

[73] Assignee: PPG Industries Ohio, Inc., Cleveland, Ohio

[21] Appl. No.: 09/074,919

[22] Filed: May 8, 1998

Related U.S. Application Data

[63] Continuation-in-part of application No. 08/770,863, Dec. 20, 1996, Pat. No. 5,863,613

[60] Provisional application No. 60/052,328, Jul. 11, 1997.

[51] Int. Cl.[6] ..... B05D 1/02; B05D 3/02; B05D 7/26; B05D 1/36

[52] U.S. Cl. ..... 427/422; 427/407.1; 427/409; 427/410

[58] Field of Search ..... 427/422, 407.1, 427/409, 410

[56] References Cited

U.S. PATENT DOCUMENTS

| | | | |
|---|---|---|---|
| 3,657,001 | 4/1972 | Parker | 117/105.1 |
| 3,776,752 | 12/1973 | Craven | 427/277 |
| 3,880,228 | 4/1975 | Houk et al. | 165/30 |
| 4,135,009 | 1/1979 | Mercurio | 427/195 |
| 4,465,922 | 8/1984 | KOlibas | 219/304 |
| 4,501,952 | 2/1985 | Lehrke | 219/305 |
| 5,068,288 | 11/1991 | Taljan et al. | 525/155 |
| 5,098,194 | 3/1992 | Kuo et al. | 427/422 |
| 5,197,676 | 3/1993 | Konieczynski et al. | 239/690 |
| 5,271,569 | 12/1993 | Konieczynski et al. | 239/690 |
| 5,290,603 | 3/1994 | Nielsen et al. | 427/422 |
| 5,395,451 | 3/1995 | Triculis | 118/666 |
| 5,538,186 | 7/1996 | Koniecyznski | 239/3 |
| 5,786,435 | 7/1998 | Marutani et al. | 526/273 |
| 5,798,145 | 8/1998 | Barancyk et al. | 427/385.5 |

FOREIGN PATENT DOCUMENTS

WO 95/22582 8/1995 WIPO .

*Primary Examiner*—Diana Dudash
*Attorney, Agent, or Firm*—William J. Uhl; Krisanne Shideler

[57] ABSTRACT

A method of applying a color-plus-clear composite coating to a substrate is provided comprising: applying to the substrate a colored film-forming composition to form a base coat and applying to the base coat a clear film-forming composition to form a transparent top coat over the base coat. Prior to application to the base coat, the clear film-forming composition is heated to a temperature and for a time sufficient to lower its viscosity such that the composition can be atomized and applied as a smooth continuous film. At a temperature of 20–25° C., the clear film-forming composition has a high viscosity such that it cannot be atomized and applied as a smooth continuous film. The clear film-forming composition comprises (1) about 65 to about 85 percent by weight, based on the total weight of resin solids in the clear film-forming composition, of a hydroxyl functional acrylic polymer having a weight average molecular weight of about 5000 to about 25,000 as determined by gel permeation chromatography using a polystyrene standard, and having a glass transition temperature of at least about 10° C.; and (2) about 15 to about 35 percent by weight, based on the total weight of resin solids in the clear film-forming composition, of an aminoplast crosslinking agent.

23 Claims, No Drawings

METHOD FOR APPLYING A COLOR-PLUS-CLEAR COMPOSITE COATING TO A SUBSTRATE

CROSS REFERENCE TO RELATED APPLICATION

This application is a Continuation in Part of application Ser. No. 08/770,863, filed Dec. 20, 1996, now U.S. Pat. No. 5,863,613. This application also claims priority to provisional application Ser. No. 60/052,328 filed Jul. 11, 1997.

FIELD OF THE INVENTION

The present invention relates to a method for applying a color-plus-clear composite coating to a substrate.

BACKGROUND OF THE INVENTION

Color-plus-clear composite coating systems involving the application of a colored or pigmented base coat to a substrate followed by the application of a transparent or clear topcoat to the base coat have become conventional as original finishes for automobiles. The color-plus-clear systems have outstanding gloss and distinctness of image, due in large part to the clear coat.

Coating systems containing hydroxyl functional polymers cured with aminoplasts are also well known and provide many excellent coating properties. They are inexpensive, durable, and attractive. However, it is widely recognized that such coatings, particularly clear coats, have poor resistance to etching by acid.

It has been found that acid etch resistance of such coatings can be improved by using high molecular weight, hydroxyl functional polymers having relatively high glass transition temperatures in combination with relatively low levels of aminoplast. However, such coating compositions have viscosities that are too high for conventional spraying techniques. The viscosity may be lowered by dilution with a solvent or diluent, but dilution adds volatile components which must be disposed of or recovered, adding to the cost of the coating system. The diluted coating composition also typically suffers from appearance problems upon application such as drips, sags, solvent popping, and the like.

It is an object of the present invention to provide a method of applying a color-plus-clear composite coating composition to a substrate, wherein the clear coating component of the composition is based on hydroxyl functional polymers and aminoplast curing agents, and the cured composition demonstrates a high level of acid etch resistance and excellent appearance properties without requiring high levels of solvents in the formulations.

SUMMARY OF THE INVENTION

In accordance with the present invention, a method for applying a color-plus-clear composite coating to a substrate is provided comprising: applying to the substrate a colored film-forming composition to form a base coat and spraying onto the base coat a clear film-forming composition to form a transparent top coat over the base coat. Prior to application to the base coat, the clear film-forming composition is heated to a temperature and for a time sufficient to lower its viscosity such that the composition can be atomized and applied as a smooth continuous film. The clear film-forming composition has a high viscosity at ambient temperatures, (i.e., at a temperature of 20–25° C.) such that it cannot be atomized and applied as a smooth continuous film using conventional application equipment. The composition comprises (1) about 65 to about 85 percent by weight, based on the total weight of resin solids in the clear film-forming composition, of a hydroxyl functional acrylic polymer having a weight average molecular weight of about 5000 to about 25,000 as determined by gel permeation chromatography using a polystyrene standard, and having a glass transition temperature of at least about 10, preferably at least about 20° C.; and (2) about 15 to about 35 percent by weight, based on the total weight of resin solids in the clear film-forming composition, of an aminoplast crosslinking agent.

DETAILED DESCRIPTION

The film-forming composition of the base coat in the color-plus-clear system can be any of the compositions useful in coatings applications, particularly automotive applications. The film-forming composition of the base coat comprises a resinous binder and a pigment to act as the colorant. Particularly useful resinous binders are acrylic polymers, polyesters, including alkyds, and polyurethanes.

The base coat compositions may be solventborne or waterborne. Waterborne base coats in color-plus-clear compositions are disclosed in U.S. Pat. No. 4,403,003, and the resinous compositions used in preparing these base coats can be used in the practice of this invention. Also, waterborne polyurethanes such as those prepared in accordance with U.S. Pat. No. 4,147,679 can be used as the resinous binder in the base coat. Further, waterborne coatings such as those described in U.S. Pat. No. 5,071,904 can be used as the base coat. Suitable solventborne coatings include any known to those skilled in the art. Examples include DCT-6373, a solventborne base coat commercially available from PPG Industries, Inc.

As mentioned above, the base coat composition contains pigments. Color pigments conventionally used in surface coatings are suitable and include, for example, inorganic pigments such as titanium dioxide, iron oxides, chromium oxide, lead chromate, and carbon black, and organic pigments such as phthalocyanine blue and phthalocyanine green. Mixtures of the above mentioned pigments may also be used. Suitable metallic pigments include in particular aluminum flake, copper bronze flake and metal oxide coated mica, nickel flakes, tin flakes, and mixtures thereof.

In general, the pigment is incorporated into the colored coating composition in amounts of about 1 to about 80 percent by weight based on the total weight of coating solids. The metallic pigment is employed in amounts of about 0.5 to about 25 percent by weight based on the total weight of coating solids.

If desired, the base coat composition may contain additional materials well known in the art of formulated surface coatings. These would include surfactants, flow control agents, thixotropic agents, fillers, anti-gassing agents, organic cosolvents, catalysts, and other customary auxiliaries. These materials can constitute up to about 40 percent by weight of the total weight of the coating composition.

The base coating compositions can be applied to various substrates to which they adhere including wood, metals, glass, and plastic. The compositions can be applied by conventional means including brushing, dipping, flow coating, spraying and the like, but they are most often applied by spraying. The usual spray techniques and equipment for air spraying and electrostatic spraying and either manual or automatic methods can be used.

During application of the base coat composition to the substrate, a film of the base coat is formed on the substrate.

Typically, the base coat thickness will be about 0.01 to about 5 mils (about 0.254 to about 127 microns), preferably about 0.1 to about 2 mils (about 2.54 to about 50.8 microns) in thickness.

After application of the base coat to the substrate, a film is formed on the surface of the substrate by driving solvent, i. e., organic solvent and/or water, out of the base coat film by heating or by an air drying period. Preferably, the heating will only be for a short period of time, sufficient to ensure that the clear coat can be applied to the base coat without dissolving the base coat composition. Suitable drying conditions will depend on the particular base coat composition, and on the ambient humidity with certain waterborne compositions, but in general a drying time of from about 1 to 5 minutes at a temperature of about 80–250° F. (20–121° C.) will be adequate to ensure that mixing of the two coats is minimized. At the same time, the base coat film is adequately wetted by the clear coat composition so that satisfactory intercoat adhesion is obtained. Also, more than one base coat and multiple clear coats may be applied to develop the optimum appearance. Usually between coats, the previously applied coat is flashed; that is, exposed to ambient conditions for about 1 to 20 minutes.

The clear film-forming composition comprises (1) about 65 to about 85 percent by weight, based on the total weight of resin solids in the clear film-forming composition, of a hydroxyl functional acrylic polymer having a weight average molecular weight of about 5000 to about 25,000 as determined by gel permeation chromatography using a polystyrene standard, and having a glass transition temperature of at least about 10, preferably 20° C.; and (2) about 15 to about 35 percent by weight, based on the total weight of resin solids in the clear film-forming composition, of an aminoplast crosslinking agent.

The hydroxyl functional acrylic polymer preferably has beta-hydroxy ester functionality, comprising the free radical initiated polymerization reaction product of:

1) about 10 to about 70 percent, preferably about 10 to about 40 percent by weight, based on the total solid weight of monomers used to prepare the polymer, of a polymerizable ethylenically unsaturated, beta-hydroxy ester functional monomer typically containing more than 5 carbon atoms in beta-hydroxy ester group;

2) about 5 to about 50 percent, preferably about 20 to about 40 percent by weight, based on the total solid weight of monomers used to prepare the polymer, of a polymerizable ethylenically unsaturated, hydroxyalkyl functional monomer typically containing from 2 to 4 carbon atoms in the alkyl group;

3) about 15 to about 40 percent, preferably about 30 to about 40 percent, based on total solids weight of the monomers used to prepare the polymer of a vinyl aromatic monomer; and 4) about 10 to about 60 percent, preferably about 10 to about 20 percent by weight, based on the total solid weight of monomers used to prepare the polymer, of an alkyl, typically aliphatic, or aryl ester of acrylic or methacrylic acid having 1 to 30 carbon atoms in the alkyl group and 6 to 30 carbon atoms in the aryl group. Polymerization is conducted in the presence of a polymerization initiator, such as a free radical initiator.

The beta-hydroxy ester functional monomer can be derived from the following:

a) an ethylenically unsaturated, epoxy functional monomer and a saturated carboxylic acid having about 13 to about 20 carbon atoms; and b) an ethylenically unsaturated acid functional monomer and an epoxy compound containing at least 5 carbon atoms which is not polymerizable with the ethylenically unsaturated acid functional monomer.

In the embodiment of the invention in which the beta-hydroxy ester functional monomer is derived from an ethylenically unsaturated, epoxy functional monomer and a saturated carboxylic acid having about 13 to about 20 carbon atoms, examples of ethylenically unsaturated, epoxy functional monomers include glycidyl acrylate, glycidyl methacrylate, allyl glycidyl ether, methallyl glycidyl ether, 1:1 (molar) adducts of ethylenically unsaturated monoisocyanates such as meta-isopropenyl-alpa,alpha,-dimethylbenzyl isocyanate with hydroxyl functional monoepoxides such as glycidol, and glycidyl esters of polymerizable polycarboxylic acids such as maleic acid, fumaric acid, and crotonic acid. Preferred are the epoxy-functional acrylates such as glycidyl acrylate, epoxy functional methacrylates such as glycidyl methacrylates, or mixtures thereof. Glycidyl methacrylate is particularly preferred.

Examples of saturated carboxylic acids include saturated monocarboxylic acids such as those which are noncrystalline at room temperature, particularly those having branched structures. Examples include stearic acid and isostearic acid. As used herein the term "saturated" as in the phrase "saturated monocarboxylic acid" is intended to denote the absence of ethylenic unsaturation but is not intended to exclude aromatic unsaturation as found, for example, in a benzene ring.

The beta-hydroxy ester functional monomer may be prepared in several ways, for example (1) the saturated carboxylic acid and unsaturated epoxy functional monomer can be pre-esterified prior to polymerization and the resultant reaction product addition polymerized, for example, by free radical initiated polymerization techniques; (2) the unsaturated epoxy functional monomer can be addition polymerized, typically along with one or more hydroxyalkyl functional monomers and one or more other additional ethylenically unsaturated monomers, in the presence of the saturated carboxylic acid under conditions which promote the carboxyl/epoxy esterification reaction; and (3) the unsaturated epoxy functional monomer can be addition polymerized, typically along with one or more hydroxyalkyl functional monomers and one or more other additional ethylenically unsaturated monomers, to form a polymeric product having epoxy functionality, which polymeric product can be subsequently esterified by reaction with the saturated carboxylic acid.

The polymerization and esterification reactions are generally conducted at from about 80° C. to about 170° C., preferably from about 120° C. to about 145° C. For pre-esterification of the saturated carboxylic acid and unsaturated epoxy functional monomer followed by reaction of the resulting adduct with other ethylenically unsaturated monomers, it may be desirable to avoid temperatures in excess of about 120° C. so as to minimize or avoid premature polymerization of the unsaturated epoxy functional monomer. Moreover, when pre-esterification is conducted, it is usually done in the presence of a catalyst for promoting the epoxy/acid reaction such as tertiary amine, phosphine, or tin catalyst. Also for pre-esterification, a free radical inhibitor may be used to inhibit polymerization.

It is preferred to conduct the polymerization and esterification reactions simultaneously since this involves one step instead of two. In conducting simultaneous esterification and polymerization, the temperature should be high enough to ensure that the polymerization and esterification are occurring at about the same rate. Where desired, an esterification catalyst such as those mentioned above may be utilized. However, such a catalyst is not necessary if the reaction temperature is high enough; for example, greater than about 130° C. In conducting the reaction, the reactive ingredients are heated, typically in the presence of a free radical initiator and optionally a chain transfer agent, in an organic solvent in which the ingredients as well as the resultant polymer product are compatible. Typically, the saturated carboxylic acid along with organic solvent is charged to a reaction vessel and heated to reflux, optionally under an inert atmosphere. The ethylenically unsaturated epoxy functional monomer and other monomers and free radical initiator are added slowly to the refluxing reaction mixture. After the addition is complete, some additional initiator may be added and the reaction mixture held at an elevated temperature to complete the reaction. The saturated carboxylic acid and epoxy functional monomer are typically in an equivalent ratio (acid to epoxy) of about 1:1; higher or lower ratios can be used as desired.

In the embodiment of the invention in which the beta-hydroxy ester functional monomer is derived from an ethylenically unsaturated acid functional monomer and an epoxy compound containing at least 5 carbon atoms which is not polymerizable with the ethylenically unsaturated acid functional monomer, examples of ethylenically unsaturated acid functional monomers include monocarboxylic acids such as acrylic acid, methacrylic acid, and crotonic acid; dicarboxylic acids such as itaconic acid, maleic acid, and fumaric acid; and monoesters of dicarboxylic acids such as monobutyl maleate and monobutyl itaconate. Acrylic acid and methacrylic acid are preferred.

The epoxy compound does not contain ethylenic unsaturation which would participate in free radical initiated polymerization with the unsaturated acid monomer. Examples of such epoxy compounds are glycidyl esters and ethers, preferably those containing from 8 to 30 carbon atoms. Examples of glycidyl ethers are glycidyl ethers of alcohols and phenols such as butyl glycidyl ether, octyl glycidyl ether, phenyl glycidyl ether and para-(tertiary-butyl) phenyl glycidyl ether.

Examples of glycidyl esters are those of the structure:

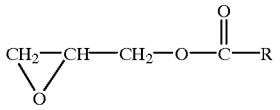

wherein R is a hydrocarbon radical containing from about 4 to about 26 carbon atoms. Preferably, R is a branched hydrocarbon radical, more preferably a tertiary aliphatic group of about 8 to about 10 carbon atoms such as neopentanoate, neoheptanoate, and neodecanoate. Glycidyl esters of commercially available mixtures of tertiary aliphatic carboxylic acids such as those available from Shell Chemical Company as VERSATIC ACID 911 are particularly preferred. The glycidyl esters themselves are also commercially available from Shell Chemical Company as CARDURA E. Examples of other epoxy compounds are 1,2-pentene oxide and styrene oxide.

The ethylenically unsaturated acid functional monomer and epoxy compound are typically in an equivalent ratio (acid to epoxy) of about 1:1. Higher or lower ratios can be used as desired. The ethylenically unsaturated acid functional monomer and epoxy compound may be pre-esterified prior to free radical initiated polymerization, or esterification and polymerization may take place simultaneously. Reaction conditions and methods are similar to those described earlier.

Suitable ethylenically unsaturated hydroxyalkyl functional monomers used to prepare the acrylic polymer include hydroxyalkyl functional acrylates and methacrylates such as hydroxyethyl acrylate, hydroxyethyl methacrylate, hydroxypropyl acrylate, hydroxypropyl methacrylate, 4-hydroxybutyl acrylate, 4-hydroxybutyl methacrylate and the like. Mixtures of these hydroxyalkyl functional monomers may also be used.

Suitable vinyl aromatic compounds include styrene, which is preferred, alpha-methylstyrene, alpha-chloromethyl styrene and vinyl toluene.

Suitable alkyl esters of acrylic and methacrylic acid or anhydride, wherein the alkyl portion of the ester contains from about 1 to about 30 carbon atoms, are those in which the alkyl group is linear or branched, aliphatic including cycloaliphatic. Suitable monomers include alkyl acrylates such as methyl acrylate, n-butyl acrylate and t-butyl acrylate, 2-ethylhexyl acrylate, isobornyl acrylate, cyclohexyl acrylate, t-butyl cyclohexyl acrylate, trimethyl cyclohexyl acrylate, lauryl acrylate, and the like; alkyl methacrylates, including methyl methacrylate, n-butyl methacrylate, t-butyl methacrylate, 2-ethylhexyl methacrylate (which is preferred), isobornyl methacrylate, cyclohexyl methacrylate, t-butyl cyclohexyl methacrylate, trimethyl cyclohexyl methacrylate, and lauryl methacrylate. Suitable aryl esters include acrylate and methacrylate esters of 2,3 secondary and tertiary butylphenol substituted in the 2,3 or 4 position and monylphenol.

Preferably, styrene is present in combination with an alkyl methacrylate containing 4 to 30 carbon atoms in the alkyl group. In a particularly preferred embodiment, styrene is used in combination with 2-ethylhexyl methacrylate. In this preferred embodiment, styrene is used in an amount of about 30 to about 40 percent by weight, based on the total solid weight of monomers used to prepare the polymer, and 2-ethylhexyl methacrylate in an amount of about 10 to about 20 percent by weight, based on the total solid weight of monomers used to prepare the polymer. Such a combination optimizes acid etch resistance and crack resistance of the cured coating.

Optionally, the polymer may be partially carbamoylated, i.e., have pendant carbamate functional groups. Such groups may be incorporated into the polymer in several ways. Carbamate functional groups may be incorporated into the polymer by copolymerizing the acrylic monomers with a carbamate functional vinyl monomer, for example a carbamate functional alkyl ester of methacrylic acid. These carbamate functional alkyl esters are prepared by reacting, for example, a hydroxyalkyl carbamate with methacrylic anhydride. Other carbamate functional vinyl monomers are, for instance, the reaction product of a hydroxyalkyl (meth) acrylate such as hydroxyethyl methacrylate, a diisocyanate such as isophorone diisocyanate, and a carbamate functional alcohol such as hydroxypropyl carbamate. Such monomers are disclosed in U.S. Pat. No. 5,098,947. Still other carbamate functional vinyl monomers may be used, such as the reaction product of isocyanic acid (HNCO) with a hydroxyl functional acrylic or methacrylic monomer such as hydroxyethyl acrylate. Carbamate groups can also be incorporated into the acrylic polymer by reacting a hydroxyl functional acrylic polymer with a low molecular weight carbamate functional material via a "transcarbamoylation" reaction. Such a reaction may be performed at about 130 to about 170° C., and at pressures up to ambient pressure. In this reaction, a low molecular weight carbamate functional material derived from an alcohol or glycol ether is reacted with the hydroxyl groups of the acrylic polymer, yielding a carbamate functional acrylic polymer and the original alcohol or glycol ether. The low molecular weight carbamate functional material derived from an alcohol or glycol ether is first prepared by reacting the alcohol or glycol ether with urea in the presence of a catalyst. Suitable alcohols include lower molecular weight aliphatic, cycloaliphatic, and aromatic alcohols such as methanol, ethanol, propanol, butanol, cyclohexanol, 2-ethylhexanol, and 3-methylbutanol. Suitable glycol ethers include ethylene glycol methyl ether and propylene glycol methyl ether. Propylene glycol methyl ether is preferred.

Examples of organic solvents which may be used in the polymerization reaction include aromatic hydrocarbons such as xylene, toluene, and naphtha; ketones such as methyl ethyl ketone, methyl amyl ketone, methyl n-butyl ketone, and methyl isobutyl ketone; esters such as butyl acetate, hexyl acetate, and heptyl acetate; glycol ethers and glycol esters such as ethylene glycol monoethyl ether, ethylene glycol monobutyl ether, propylene glycol monomethyl ether, propylene glycol monoethyl ether, dipropylene glycol monoethyl ether, propylene glycol monoethyl ether acetate, and isobutyl isobutyrate. Alcohols such as lower alkanols and simple glycols may also be used, but are not preferred.

Suitable free radical initiators are those which are soluble in the polymerization medium, including azo compounds such as alpha,alpha'-azobis-(isobutyronitrile), azobis-(alpha, gamma-dimethyl valeronitrile), and 2,2'-azobis (methylbutyronitrile); peroxides such as benzoyl peroxide, ditertiarybutyl peroxide, and cumene hydroperoxide; tertiary butyl peracetate; isopropyl percarbonate; butyl isopropyl peroxy carbonate; and similar compounds. The quantity of initiator may vary considerably depending on the type, but usually is between about 0.5 and about 7 percent by weight based on the total solid weight of monomers used to prepare the polymer.

The acrylic polymer used in the clear film-forming composition typically has a weight average molecular weight of about 5000 to about 25,000 as determined by gel permeation chromatography using a polystyrene standard. Molecular weights less than about 5000 are less desirable because acid etch resistance of the cured coating may be compromised; whereas molecular weights greater than 25,000 are undesirable because higher molecular weights contribute to higher viscosities, making the film-forming composition difficult to spray even at elevated temperatures while maintaining good appearance and acceptable solvent levels. The hydroxyl equivalent weight of the polymer is generally about 300 to about 800, preferably about 300 to about 500.

The polymer used in the film-forming composition of the present invention preferably has a glass transition temperature ($T_g$) of at least about 10, more preferably at least about 20 and most preferably at least about 30° C. $T_g$'s less than 10 are less desirable because acid etch resistance of the cured coating may be compromised. The $T_g$ is described in *PRINCIPLES OF POLYMER CHEMISTRY,* Flory, Cornell University Press, Ithaca, N.Y., 1953, pages 52–57. The $T_g$ can be calculated as described by Fox in *Bull. Amer. Physic. Society,* 1,3, page 123 (1956). The $T_g$ can be measured experimentally by using a penetrometer such as a Du Pont 940 Thermomedian Analyzer. The $T_g$ of the polymers as used herein refers to the calculated values unless otherwise indicated.

The acrylic polymer is present in the clear film-forming composition in amounts of about 65 to about 85, preferably 65 to 75 percent by weight based on the total weight of resin solids in the clear film-forming composition. Levels that are too high (i.e., above 85 percent) can lead to insufficient cure, while levels that are too low (i.e., below 65 percent) can cause reduced acid etch resistance.

The clear film-forming composition further comprises an aminoplast crosslinking agent containing methylol and/or methylol ether groups. Aminoplasts are obtained from the reaction of formaldehyde with an amine or amide. The most common amines or amides are melamine, urea, or benzoguanamine, and are preferred. However, condensates with other amines or amides can be used; for example, aldehyde condensates of glycoluril, which give a high melting crystalline product which is useful in powder coatings. While the aldehyde used is most often formaldehyde, other aldehydes such as acetaldehyde, crotonaldehyde, and benzaldehyde may be used.

The aminoplast contains imino and methylol groups and preferably at least a portion of the methylol groups are etherified with an alcohol to modify the cure response. Any monohydric alcohol may be employed for this purpose including methanol, ethanol, n-butyl alcohol, isobutanol, and hexanol.

Preferably, the aminoplasts which are used are melamine-, urea-, or benzoguanamine-formaldehyde condensates at least partially etherified with one or more alcohols containing from one to four carbon atoms. The aminoplast preferably has a high imino content. By "high" is meant about 25% imino functionality. A particularly preferred aminoplast is available from CYTEC Industries as CYMEL 202. In this embodiment, the aminoplast is present in the film-forming composition in amounts of about 20 to about 35, preferably about 25 to 30 percent by weight based on the total weight of resin solids in the film-forming composition.

Also preferred are aminoplasts in which the methylol groups are at least partially etherified with at least one alcohol selected from the group consisting of methanol, n-butyl alcohol, and isobutanol. A preferred aminoplast is available from Monsanto Chemical Company as RESIMENE 751, a highly monomeric melamine etherified with both methanol and n-butanol. Alternatively, the aminoplast is preferably at least partially etherified with isobutanol. A particularly preferred aminoplast is available from CYTEC Industries as CYMEL 1161. In this embodiment, the aminoplast is present in the film-forming composition in amounts of about 20 to about 35, preferably about 25 to 30 percent by weight based on the total weight of resin solids in the film-forming composition.

The film-forming composition of the present invention may also contain adjuvant curing agents such as a capped polyisocyanate. The polyisocyanate can be an aliphatic or an aromatic polyisocyanate or a mixture of the two. Diisocyanates may be used, although higher polyisocyanates such as isocyanurates of diisocyanates are preferred. Higher polyisocyanates can also be used in combination with diisocyanates. Isocyanate prepolymers, for example, reaction products of polyisocyanates with polyols can also be used.

If the polyisocyanate is capped, any suitable aliphatic, cycloaliphatic, or aromatic alkyl monoalcohol known to those skilled in the art may be used as a capping agent for the polyisocyanate. Other suitable capping agents include oximes and lactams. In the first embodiment of the invention, the film-forming composition of the present invention preferably contains a fully capped polyisocyanate. A preferred polyisocyanate is isophorone diisocyanate capped with methyl ethyl ketoxime.

Other capped polyisocyanate curing agents include triazines such as tricarbamoyl triazine compounds having the formula $C_3N_3(NHCOXR)_3$, wherein X is nitrogen, oxygen, sulfur, phosphorus, or carbon, and R is a lower alkyl group having one to twelve carbon atoms, or mixtures of lower alkyl groups. Such compounds and the preparation thereof are described in U.S. Pat. No. 5,084,541.

When used, the adjuvant crosslinking agent is present in the film-forming composition in an amount up to about 20, preferably from 1 to 20 percent by weight based on the total weight of resin solids in the film-forming composition.

Usually the clear film-forming composition will also preferably contain catalysts to accelerate the cure of the aminoplast with reactive groups on the polymer. Examples of suitable catalysts are acidic materials and include acid phosphates and sulfonic acid or a substituted sulfonic acid such as dodecylbenzene sulfonic acid or paratoluene sulfonic acid. The catalyst is usually present in an amount of about 0.5 to about 5.0 percent by weight, preferably about 0.5 to about 1.5 percent by weight, based on the total weight of resin solids. Optional ingredients such as, for example, plasticizers, surfactants, thixotropic agents, anti-gassing agents, organic cosolvents, flow controllers, anti-oxidants, UV light absorbers and similar additives conventional in the art may be included in the composition. These ingredients are typically present at up to about 40% by weight based on the total weight of resin solids.

The clear film-forming composition may be solventborne or waterborne; preferably it is solventborne. Suitable solvent carriers include the various alcohols, esters, ethers, aromatic solvents, and other solvents, including mixtures thereof, that are known in the art of coating formulation. The clear film-forming composition typically has a total solids content of about 40 to about 60 percent by weight. At ambient temperature, i.e., 20–25° C., the clear film-forming composition has a high viscosity such that it cannot be atomized and applied as a smooth continuous film using conventional application equipment. By this is meant the high viscosity composition either cannot be atomized or, if atomized, the resulting film is rough in appearance. Typically, the clear film-forming compositions will have viscosities of about 40 to about 100 seconds, or higher, depending on the molecular weight of the acrylic polymer, at ambient temperature as measured by a #4 Ford cup.

The clear film-forming composition (clear coat) is applied to the base coated substrate by spraying. Any known paint spraying devices such as air spray or electrostatic spray devices may be used. Prior to spraying, the clear coat is heated for a time and to a temperature sufficient to lower the viscosity of the clear film-forming composition such that the composition can be atomized and applied as a smooth continuous film. Viscosities within the range of about 25 to about 30 seconds measured using a #4 Ford cup are typical. Temperatures of about 100 to about 250° F. (about 37.8 to about 121.1° C.) are suitable. Heating can be done in a heat exchanger preferably located closely adjacent to the paint spray device, as described in U.S. application Ser. No. 08/770,863 entitled "Apparatus and Method for Spray Painting of an Article", in order to prevent long residence times of the heated composition in the spray apparatus, and the clear coat is heated only once prior to being sprayed in order to prevent possible damage to the clear coat composition. The conduit connecting the heat exchanger to the paint spray device may be insulated to minimize heat loss from the paint during any short interruptions in spraying operations.

Any type of heat exchange unit known to those skilled in the art may be used, such as conventional tube-and-shell or coil-in-tube heat exchangers that use a heat exchange medium for indirect transfer of heat to the clear coat paint.

The heat exchange units are preferably metallic heat exchangers, more preferably composed of a non-corrosive metal or alloy such as stainless steel. The volume of paint heated in a heat exchange unit is only about 100 to about 1000 cc, preferably about 100 to about 500 cc, and the volume of heated paint between the heat exchange unit and the spray device is 15 percent or less, preferably ten percent or less, of the volume of the heat exchange unit. A particularly preferred heat exchanger, available from St. Clair Systems of Romeo, Mich., is a stainless steel cylinder about 20 inches (50.8 cm) long and 2.5 inches (6.35 cm) in diameter with an axial bundle of 318 stainless steel tubes, with a paint capacity of 250 cc. In order to keep the volume of heated paint at a minimum, the volume of heated paint should be only about one to three times the volume per minute of flow of paint through the heat exchanger.

When the spray device is an electrostatic spray unit, the heat exchange medium should be a high dielectric oil in order to prevent any bleed-off of voltage or current from the electrostatic spray device to the heat exchanger. An example of a suitable oil is DIALA OIL AX sold by Shell Oil Company.

A plurality of spray apparatus units may be provided in parallel, each comprising a paint supply reservoir, a heat exchange unit, and a spray device. A common oil supply may be used to heat the heat exchange medium which is provided to each heat exchanger. The common oil supply may be a drum heated by means such as electric band heaters attached to the drum, with oil transfer lines communicating between the common oil supply and the plurality of heat exchange units.

After application of the clear coat composition to the base coat, the coated substrate is heated to cure the coating layers. In the curing operation, solvents are driven off and the film-forming materials of the clear coat and the base coat are each crosslinked. The heating or curing operation is usually carried out at a temperature in the range of from 160–350° F. (71–177° C.) but if needed, lower or higher temperatures may be used as necessary to activate crosslinking mechanisms. The thickness of the clear coat is usually from about 0.5 to about 5 mils (about 12.7 to about 127 microns), preferably about 1.2 to about 3 mils (about 30.5 to about 76.2 microns). The resultant crosslinked coating exhibits a high level of acid etch resistance. By "high level" it is meant that the resistance of the coating composition to etching by acid rain is significantly improved compared to conventional high solids hydroxyl-aminoplast cured coating compositions.

The invention will further be described by reference to the following examples. Unless otherwise indicated, all parts are by weight.

EXAMPLE A

This example illustrates the preparation of an acrylic polyol.

A reaction vessel equipped with stirrer, thermocouple, condenser and addition funnels with pumps was charged with 720.5 g n-butyl acetate, 131.0 g xylene and 421.2 g glycidyl neodecanoate and heated to reflux (about 135° C.). Two feeds, identified herein as Feed A and Feed B, were gradually and simultaneously added to the vessel over a period of 3 hours while the contents of the vessel were maintained at reflux conditions. Feed A consisted of a mixture of 672.0 g styrene, 484.8 g hydroxyethyl methacrylate, 320.0 g methyl methacrylate and 123.2 g acrylic acid. Feed B consisted of a mixture of 80.0 g t-amyl peroxy-2-ethyl hexanoate (LUPEROX 575 available from Elf-Atochem) and 262.0 g 2-ethoxyethyl propionate. After the addition of the two feeds A and B was complete, a mixture of 3.2 g LUPEROX 575 and 13.1 g xylene was added and the reaction contents stirred for one hour. After this time another addition consisting of 3.2 g LUPEROX 575 and 13.1 g xylene was made. The reaction contents were stirred for an additional hour and cooled while adding 170.3 g n-butyl acetate.

The resultant product had a total solids content of 60.3% measured for 1 hour at 110° C.; a viscosity of 33.3 stokes; had an acid value of 7.51 mg KOH/g; a hydroxyl value of 94.1 mg KOH/g; had an APHA color of 15–20; and a weight average molecular weight of 11,200 and a $T_g$ of 50° C.

EXAMPLES 1 AND 2

Examples 1 and 2 illustrate the preparation of clear film-forming compositions using the polymeric acrylic polyol of Example A. Example 1 is illustrative of the present invention. Example 2 is comparative. The clear coat of Example 2 contains aminoplast in an amount higher than that of the present invention; i.e., 45%, based on the total weight of resin solids in the film-forming composition.

The ingredients for each composition were mixed together in the order listed:

| Ingredient | Total (graas) | |
|---|---|---|
| | Example 1 | Example 2 |
| SOLVESSO 100[1] | 49 | 49 |
| DME dibasic ester[2] | 5 | 5 |
| TINUVIN 328[3] | 8.3 | 8.3 |
| Flow control agent[4] | 9.5 | 9.5 |
| CYMEL 1161[5] | 87 | 130 |
| Acrylic polyol of Example A | 333 | 261 |
| n-Propyl alcohol | 14 | 14 |
| Poly (Butyl Acrylate)[6] | 1.6 | 1.6 |
| MULTIFLOW[7] | 1.8 | 1.8 |
| TINUVIN 123[8] | 1.5 | 1.5 |
| DDBSA/DIPA[9] | 4.3 | 4.3 |

[1]Blend of aromatic solvents available from Exxon Chemicals America.
[2]Dibasic ester solvent available from E. I. du Pont de Nemours and Co., CAS# 1119-40-0.
[3]2-(2'-Hydroxy-3',5'-ditert-amylphenyl) benzotriazole UV light stabilizer available from Ciba Specialty Chemicals.
[4]Prepared as generally described in U.S. Pat. No. 4,147,688, Example 11.
[5]Highly monomeric, isobutylated melamine formaldehyde resin available from CYTEC Industries, Inc.
[6]Flow control agent having a Mw of about 6700 and a Mn of about 2600, made in xylene at 62.5% solids.
[7]Polymer made of 75% by weight 2-ethyl hexyl acrylate, 25% by weight ethyl acrylate with a number average molecular weight of about 7934; 50% solids in xylene. Available from Monsanto Company.
[8]Sterically hindered aminoether light stabilizer available from Ciba Geigy Corporation.
[9]Dodecylbenzene sulfonic acid neutralized with diisopropanolamine, in 40% weight solution in isopropanol.

The film-forming compositions of Examples 1 and 2 had viscosities of about 45 seconds (measured at 80° F. (26.7° C.) with a number 4 Ford cup) and samples of each were reduced to viscosities of about 25 seconds with SOLVESSO 100. The film-forming composition of Example 1 (both viscosities) was spray applied in two coats as a clear coat over a black solventborne base coat, available from PPG Industries, Inc., as HDCT9939M. Spray applications were done at room temperature and at an elevated paint temperature of 140° F. (60° C.). The base coat was flashed for five minutes at 200° F. (93.3° C.) before application of the clear coat. The clear coats were given a ten-minute air flash before baking for thirty minutes at either 250° F. (121.1° F.) or 300° F. (149° C.). Spray applications of the film-forming composition of Example 2 (both viscosities) was done at room temperature only. Flashing and curing conditions were the same.

The following table summarizes the properties measured on these color-plus-clear composite coatings:

| Example | Viscosity | Cure Temp. (° C.) | Spray Temp. (° C.) | DOI[1] | Acid Etch[2] | Water Spot[3] |
|---|---|---|---|---|---|---|
| 1 | 25" | 121.1 | 60 | 97.0 | 3 | 1–2 |
| 1 | 45" | 121.1 | 60 | 92.0 | 3 | 2 |
| 1 | 25" | 149 | 60 | 96.0 | 3 | 1 |
| 1 | 45" | 149 | 60 | 87.0 | 4 | 1 |
| 1 | 25" | 121.1 | RT[4] | 97 | 4 | 2–3 |
| 1 | 45" | 121.1 | RT | 81 | 4 | 2 |
| 1 | 25" | 149 | RT | 91 | 4 | 1–2 |
| 1 | 45" | 149 | RT | 65 | 4 | 1–2 |
| 2 | 25" | 121.1 | RT | 95 | 4 | 3 |
| 2 | 45" | 121.1 | RT | 68.3 | 4 | 2–3 |
| 2 | 25" | 149 | RT | 88 | 4 | 2 |
| 2 | 45" | 149 | RT | 55 | 4 | 1–2 |

[1]DOI (distinctness of image) measured using a Dorigon II DOI meter from Hunger Lab. Higher numbers indicate better clarity.
[2]Acid Etch resistance is measured as follows: One spot of 0.6 N sulfuric acid solution (pH = 2.0) is placed on a test panel using a pipette. The test panel is then placed horizontally in an oven at 120° F. (48.9° C.) for thirty minutes. After removal from the oven, the test panel is washed with soap and water, rinsed, dried, and visually inspected for rating on a scale of 1 to 6 (1 = no mark on surface; 6 = etching of panel with erosion of film down to electrocoat primer.)
[3]Water spot resistance is measured as follows: six spots of tap water are placed on a test panel using a pipette. The first spot is one drop of water, the second spot is two drops, the third spot is three drops, etc. The test panel is then placed horizontally in an oven at 140° F. (60° C.) for thirty minutes. After removal from the oven, the test panel is washed with soap and water, rinsed, dried, and visually inspected for rating on a scale of 1 to 6 (1 = no mark on surface; 6 = severe spotting of the panel.)
[4]Room temperature, about 25 to 28° C.

The data in the table indicate that coating compositions prepared according to the present invention and sprayed at an elevated temperature yield finished coatings with excellent appearance, as measured by DOI, without loss of cured film properties. Reduction of viscosity to conventional levels is not necessary and only increases the VOC (volatile organic content) of the composition.

When sprayed at room temperature, compositions of the present invention and comparative compositions have acceptable DOI only at reduced viscosities (and hence lower solids; higher VOC.) In addition, water spotting resistance of the composition containing higher levels of aminoplast (Example 2) is not quite as good as that of the present invention.

We claim:

1. A method of applying a color-plus-clear composite coating to a substrate which comprises applying to the substrate a colored film-forming composition to form a base coat and spraying onto said base coat a clear film-forming composition to form a transparent top coat over the base coat wherein the clear film-forming composition comprises (1) about 65 to about 85 percent by weight, based on the total weight of resin solids in the clear film-forming composition, of a hydroxyl functional acrylic polymer having a weight average molecular weight of about 5000 to about 25,000 as determined by gel permeation chromatography using a polystyrene standard, and having a glass transition temperature of at least about 10° C.; and (2) about 15 to about 35 percent by weight, based on the total weight of resin solids in the clear film-forming composition, of an aminoplast crosslinking agent; wherein prior to application to said base coat, the clear film-forming composition is heated to a temperature and for a time sufficient to lower the viscosity of the clear film-forming composition such that the composition can be atomized and applied as a smooth continuous film; and wherein the clear film-forming composition has a viscosity at a temperature of 20–25° C. such that it cannot be atomized and applied as a smooth continuous film at a temperature of 20–25° C.

2. The method of claim 1 wherein the clear film-forming composition is heated in a heat exchange unit located adjacent to a paint spray device through which the clear film-forming composition is subsequently sprayed.

3. The method of claim 1 wherein said paint spray device comprises an electrostatic spray device and said clear film-forming composition is heated in said heat exchange unit by indirect heat transfer from a hot dielectric oil.

4. The method of claim 1 wherein the volume of heated clear film-forming composition between said heat exchange unit and said paint spray device is about 15 percent or less of the volume of clear film-forming composition in said heat exchange unit.

5. The method of claim 1 wherein only about 100 to about 1000 cc of clear film-forming composition is heated in said heat exchange unit at any time.

6. The method of claim 1 wherein the volume of heated clear film-forming composition is about one to three times the volume per minute of flow of composition through said heat exchange unit.

7. The method of claim 1 wherein the clear film-forming composition is heated in said heat exchange unit to a temperature of about 100 to about 250° F. (about 37.8 to about 121.1° C.).

8. The method of claim 1 wherein the hydroxyl functional acrylic polymer contains beta-hydroxy ester functionality.

9. The method of claim 1 wherein the clear film-forming composition comprises:

A) a hydroxyl functional acrylic polymer prepared from the following ingredients:

1) about 10 to about 70 percent by weight, based on the total solid weight of monomers used to prepare the polymer, of a beta-hydroxy ethylenically unsaturated monomer containing at least 5 carbon atoms in the beta-hydroxy ester group;

2) about 5 to about 50 percent by weight, based on the total solid weight of monomers used to prepare the polymer, of an ethylenically unsaturated, hydroxyalkyl functional monomer containing from 2 to 4 carbon atoms in the alkyl group;

3) about 10 to about 40 percent by weight, based on the total solid weight of monomers used to prepare the polymer, of a vinyl aromatic compound; and 4) about 10 to about 60 percent by weight, based on the total solid weight of monomers used to prepare the polymer, of an aliphatic alkyl ester of acrylic or methacrylic acid containing from 1 to 30 carbon atoms; and B) an etherified aminoplast crosslinking agent.

10. The method of claim 9, wherein the beta-hydroxy ethylenically unsaturated monomer is the reaction product of an ethylenically unsaturated acid functional monomer and an epoxy compound containing at least 5 carbon atoms which is not polymerizable with the ethylenically unsaturated acid functional monomer.

11. The method of claim 10, wherein the epoxy compound has the following structure:

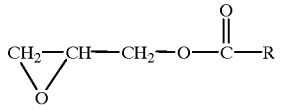

wherein R is a hydrocarbon radical containing from about 4 to about 26 carbon atoms.

12. The method of claim 10, wherein the ethylenically unsaturated acid functional monomer is selected from the group consisting of acrylic acid, methacrylic acid, itaconic acid and mixtures thereof.

13. The method of claim 9 wherein the beta-hydroxy ethylenically unsaturated monomer is the reaction product of an ethylenically unsaturated, epoxy functional monomer and a saturated carboxylic acid having about 13 to about 20 carbon atoms.

14. The method of claim 13, wherein the epoxy functional monomer is glycidyl methacrylate.

15. The method of claim 13, wherein the saturated carboxylic acid is isostearic acid.

16. The method of claim 13, wherein the clear film-forming composition further comprises a capped polyisocyanate.

17. The method of claim 16, wherein the capped polyisocyanate is isophorone diisocyanate capped with methylethyl ketoxime.

18. The method of claim 9, wherein the ethylenically unsaturated, hydroxyalkyl functional monomer is selected from the group consisting of hydroxyethyl acrylate, hydroxyethyl methacrylate, hydroxypropyl acrylate, hydroxypropyl methacrylate, 4-hydroxybutyl acrylate, 4-hydroxybutyl methacrylate, and mixtures thereof.

19. The method of claim 9, wherein the alkyl ester of acrylic or methacrylic acid containing from 1 to 30 carbon atoms is 2-ethylhexyl methacrylate.

20. The method of claim 9, wherein the vinyl aromatic monomer is styrene.

21. The method of claim 20, wherein styrene is present in an amount of about 30 to about 40 percent, and 2-ethylhexyl methacrylate is present in an amount of about 10 to about 20 percent, based on the total solid weight of monomers used to prepare the polymer.

22. The method of claim 16, in which the capped polyisocyanate is present in amounts up to about 20 percent by weight based on the total weight of resin solids in the film-forming composition.

23. The method of claim 22, wherein said capped polyisocyanate is a tricarbamoyl triazine compound having the formula $C_3N_3(NHCOXR)_3$, wherein X is nitrogen, oxygen, sulfur, phosphorus, or carbon, and R is a lower alkyl group having one to twelve carbon atoms or mixtures of lower alkyl groups.

* * * * *